US008177092B2

(12) United States Patent
Mills

(10) Patent No.: US 8,177,092 B2
(45) Date of Patent: May 15, 2012

(54) CAN END

(75) Inventor: Gary Hilaire Mills, Wantage (GB)

(73) Assignee: Crown Packaging Technology, Inc., Alsip, IL (US)

( * ) Notice: Subject to any disclaimer, the term of this patent is extended or adjusted under 35 U.S.C. 154(b) by 993 days.

(21) Appl. No.: 11/166,227

(22) Filed: Jun. 27, 2005

(65) Prior Publication Data

US 2005/0284869 A1 Dec. 29, 2005

(30) Foreign Application Priority Data

Jun. 26, 2004 (EP) ..... 04253845

(51) Int. Cl.

| | |
|---|---|
| ***B65D 17/34*** | (2006.01) |
| ***B65D 17/46*** | (2006.01) |
| ***B65D 17/52*** | (2006.01) |
| ***B65D 43/26*** | (2006.01) |

(52) U.S. Cl. ..... 220/271; 220/272; 220/279; 220/285

(58) Field of Classification Search ..... 220/271, 220/272, 279, 285

See application file for complete search history.

(56) References Cited

U.S. PATENT DOCUMENTS

| | | | | |
|---|---|---|---|---|
| 2,894,844 | A | 7/1959 | Shakman | |
| 3,951,299 | A * | 4/1976 | Khoury | 220/273 |
| 4,015,744 | A | 4/1977 | Brown | |
| 4,030,631 | A * | 6/1977 | Brown | 220/269 |
| 4,043,479 | A | 8/1977 | Khoury | |
| 5,819,973 | A * | 10/1998 | Traub et al. | 220/271 |
| 6,347,720 | B1 * | 2/2002 | Schley | 220/258.4 |
| 2002/0014489 | A1 * | 2/2002 | Anthony et al. | 220/271 |

FOREIGN PATENT DOCUMENTS

EP 0 521 642 B1 12/1996

* cited by examiner

*Primary Examiner* — Anthony Stashick
*Assistant Examiner* — Andrew T Kirsch
(74) *Attorney, Agent, or Firm* — Miles & Stockbridge P.C.; David R. Schaffer, Esq.; Michael A. Minter, Esq.

(57) ABSTRACT

An easy open end for a pressurized food container, having an end panel and a conventional aperture score, surrounding the periphery of an aperture through which the contents of the container may be dispensed. A tab is provided to facilitate easy opening of the aperture. The easy open end also includes a vent score, which is arranged to rupture before the main aperture score, to vent the internal pressure in the container, before the container is opened. The end panel and/or tab also defines a shield to prevent the egress of product from the vent opening, when the vent score is severed.

13 Claims, 6 Drawing Sheets

PRIOR ART.

CAN END

BACKGROUND OF THE INVENTION

The present invention relates to an end adapted for use on a pressurised container. In particular, the invention provides an easy open end suitable for use on a pressurised food can or the like. In a pressurised food can, the food product is inserted into the can and stored therein under pressure. The increased pressure in the can is achieved by pressurising the headspace above the food product.

This may be achieved in a number of different ways. For example, a droplet of liquefied, inert gas may be inserted into the can just prior to sealing, as described in U.S. Pat. No. 2,894,844. The liquid evaporates and the resultant gas pressurises the headspace. Alternatively, a portion of the can may be designed such that it can be irreversibly deformed inwardly. After filling the can and sealing the open end thereof, the deformable portion of the can is deformed inwardly, thereby reducing the volume of the headspace and pressurising the headspace gases. This technique is described in European Patent No. EP 0 521 642.

The advantage of pressurising a food can is that the can may be made of substantially thinner gauge metal, which is deformable under normal conditions. The increased internal pressure in the can helps to support the walls of the can, providing the rigidity required for handling and transport. The use of thinner gauge metal has significant cost benefits to the can manufacturer and also has significant environmental benefits.

Conventional food cans comprise a body, in which a food product is stored, and at least one separate end, which is connected to the free edge of the body, conventionally by seaming and in particular by a technique known as "double seaming". Conventional ends comprise a flat plate-like centre panel connected to a seaming portion (often referred to as the "cover hook") via a chuck wall, which supports a seaming chuck during the double seaming operation. At the base of the chuck wall a concave reinforcing bead (looking from the outside of the can) is normally provided, to strengthen the end and support the seam.

Some food cans are provided with an easy open end, which is connected to the can body in the same manner as a conventional end. An easy open end differs from the convention end in that a thinned score line is provided on the flat plate-like centre panel, around the periphery of a desired aperture. A tab is connected to the end, usually by a rivet, and the tab has a tail portion and a nose portion arranged on either side of the rivet. The tab is located on the plate-like centre panel with the nose portion overlying or adjacent to the thinned score line, defining the desired aperture. On opening, a consumer lifts the tail portion of the tab, which causes the tab to pivot (axially) about the rivet, pressing the nose portion against the score line area of the can end. This pressure causes the score line to rupture around the periphery of the aperture. The aperture panel may then be pulled free from the remainder of the can, allowing access to the contents of the container.

A container, whose contents are held under pressure, has the disadvantage that upon first opening by a consumer, the pressure inside the container is rapidly released to atmosphere and the stream of released gases may carry a quantity of product. This problem is particularly difficult when the product in the container is coloured and/or viscous, as this may spoil a consumers clothes, or where the product is potentially harmful to a consumer. This problem is referred to as "spurting" and is highly undesirable for the consumer. In extreme circumstances, such "spurting" may have explosive force making the can dangerous. The present invention is concerned with controlling "spurting" i.e. controlling the forceful ejection of headspace gases and entrained product particles upon first opening of a pressurised container.

A further problem with containers having so called easy open ends is that once rupture of the score line is initiated the rapid release of pressured gases from inside the container may result in uncontrolled severing of the score line, causing the aperture panel to missile. Such missiling is potentially very dangerous.

SUMMARY OF THE INVENTION

Accordingly, the present invention provides an easy open end for sealing a pressurised container, such as a food can or the like.

The end has a vent score, which is ruptured to form a vent opening, before the main aperture score begins to rupture. The vent opening allows the internal pressure in the container to be released whilst the aperture score, remains largely intact. This two-stage opening prevents missiling of the aperture panel, because the pressure in the container is largely released, before the container is opened. Furthermore, the end panel and/or tab is designed to define a shield, which ensures that any product entrained within the pressurised gases ejected from the vent opening is retained in the area surrounding the vent opening and does not make contact with the consumer.

With the above and other objects in view that will hereinafter appear, the nature of the invention will be more clearly understood by reference to the following detailed description, the appended claims and the several views illustrated in the accompanying drawings.

DETAILED DESCRIPTION OF THE PREFERRED EMBODIMENTS

Figure 1:
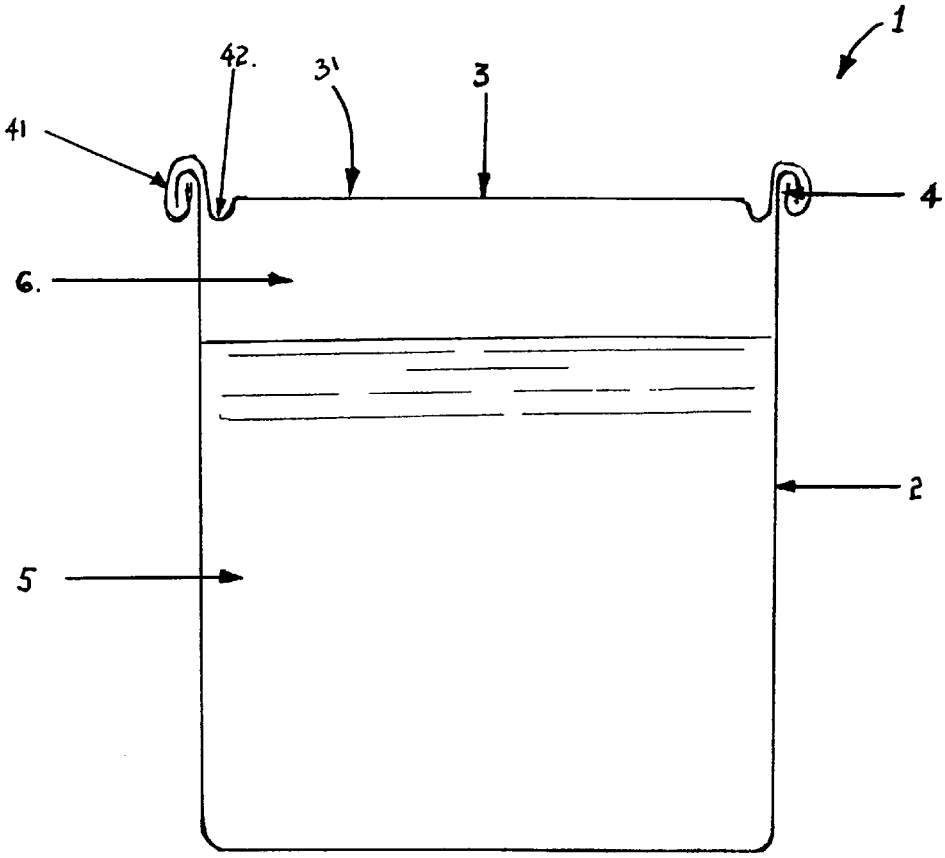
FIG. 1 shows a conventional food can filled with product after the associated end has been sealed to the food can.

Referring to FIG. 1, a conventional food can 1 includes a body 2 and an associated end 3. The end 3 has a flat plate-like centre panel 31, a reinforcing bead 42 and a cover hook 41. The food can 1 is filled with a product 5 to a predetermined fill height, thus leaving an unfilled headspace 6. The end 3 is placed over the free end of the can body 2 and supported thereon by the cover hook 41. Thereafter, a portion of the cover hook 41 and the free edge of the can body 2 is rolled together, to form a double seam 4 in a known process.

Figure 2:
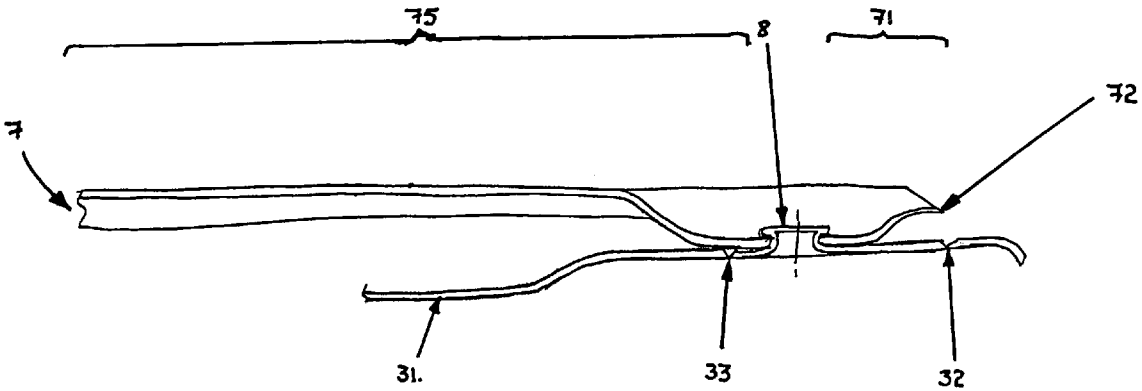
FIG. 2 shows a side section view of a conventional easy-open food can end prior to opening, having a tab and a "moustache" score vent.
Figure 3:
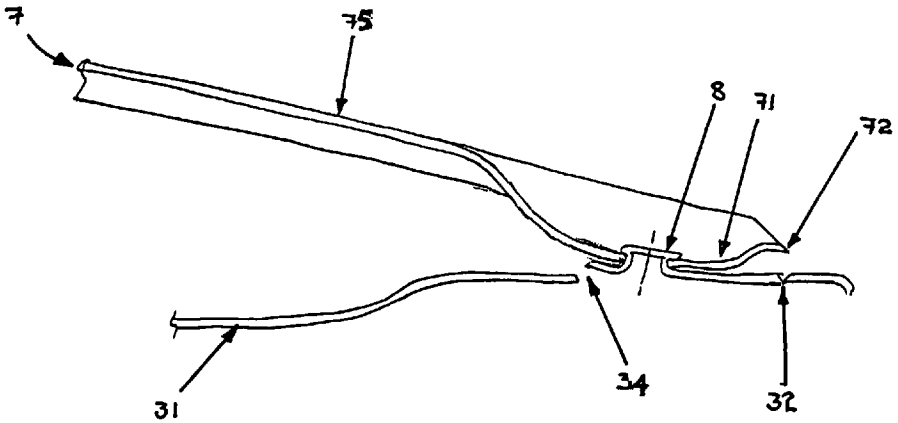
FIG. 3 shows a side section of the same end as shown in FIG. 2, after the tail portion of the tab has been lifted to the extent necessary to open the vent score, but prior to severing of the main aperture score.
Figure 4:
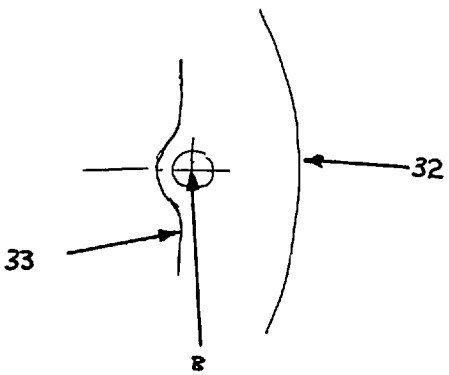
FIG. 4. PRIOR ART
FIG. 4 shows a plan view of a portion of the can end shown in FIGS. 2 and 3 prior to attachment of the tab, showing the layout of the vent score and main aperture score in relation to the position of the rivet.

Referring to FIGS. 2, 3 and 4 a conventional easy-open food can end further defines an aperture score 32, which ruptures to release an aperture panel (not shown), to allow access to the contents of the food can without the need to use a separate opening device. The conventional easy open end again comprises a flat plate-like centre panel 31 on which the aperture score is defined. A tab 7 is fixed to the centre panel 31 by a rivet 8 and comprises a nose portion 71 and a tail portion 75, arranged on either side of the rivet 8. The free end of the nose portion 71 of the tab 7 defines a nose 72, which is used to propagate severing of the aperture score 32 by pressing on or adjacent to it. Thus, the tab 7 is arranged on the centre panel 31 with the nose portion 71 lying in a position where the nose 72 can press on or adjacent to the aperture score.

On first opening, a user lifts the tail portion 75 of the tab 7 rotating it vertically about the rivet 8 and thereby pressing the nose 72 on or adjacent to the aperture score 32, to propagate severing thereof.

The end panel 31 has a further vent score 33 overlain by the tail portion of the tab 75 adjacent to the rivet 8. This vent score 33 (often referred to as a moustache score due to its shape) is arranged to sever before the nose 72 touches the area around the aperture score 32. The vent score 33 severs to form a vent opening 34, which allows the pressure in the can to equalise with atmospheric pressure. During processing, the product 5 in the can is heated and may release vapour. Upon cooling the vapour may condense creating a partial vacuum in the container 1. The vent opening 34 allows the pressure inside the container 1 to equalise with atmospheric pressure prior to severing of the aperture score 32, thus preventing implosion of the aperture panel. This two-stage opening (i.e. pressure equalisation then severing of the aperture score 32) is particularly important in pressurised food cans, where the pressure in the food can is substantially higher than atmospheric pressure.

Figure 5:
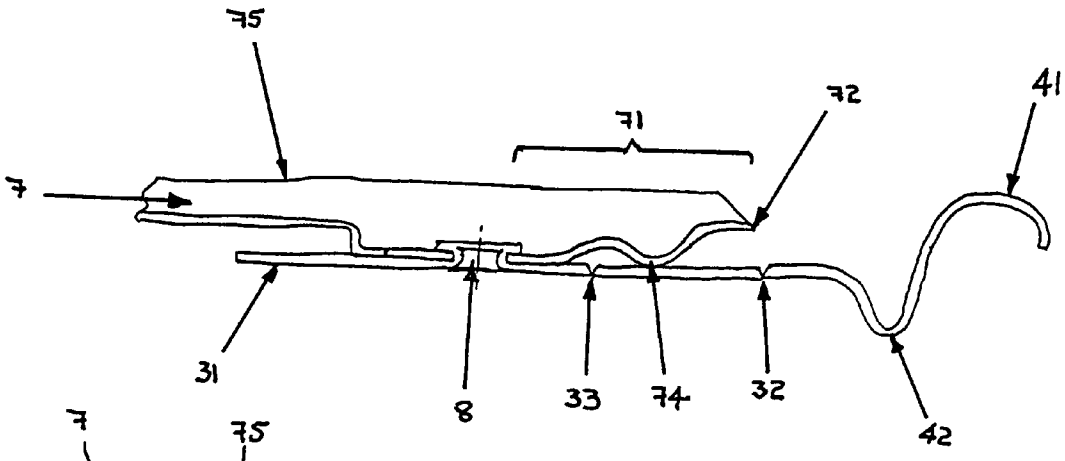
FIG. 5 shows a side section view of a first embodiment of an easy-open food can end according to the invention prior to opening, having a vent score arranged to be overlain by the nose portion of the tab.
Figure 6:
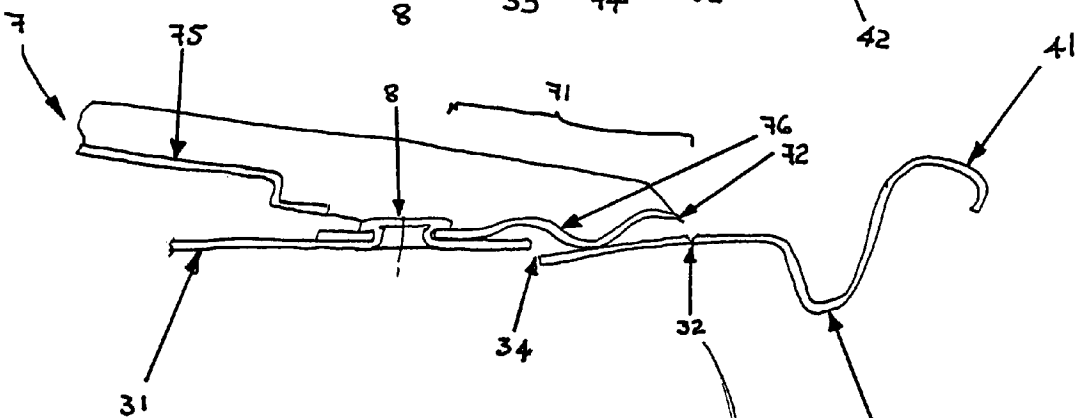
FIG. 6 shows a side section of the same end as shown in FIG. 5, after the tail portion of the tab has been lifted to the extent necessary to open the vent score, but prior to severing of the main aperture score.
Figure 7:
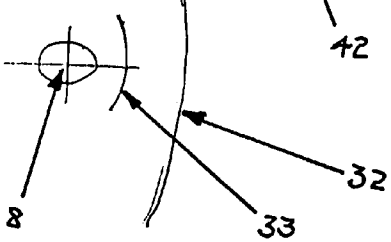
FIG. 7 shows a plan view of a portion of the can end shown in FIGS. 5 and 6 prior to attachment of the tab, showing the layout of the vent score and main aperture score in relation to the position of the rivet.

In a first embodiment of the invention (as shown in FIGS. 5, 6 and 7) the food can end has a cover hook 41, reinforcing bead 42 and a tab 7 affixed to the centre panel 31 by a rivet 8. An aperture score 32 and vent score 33 are provided, but in this embodiment the vent score 33 is overlain by the nose portion 71 of the tab 7. The nose portion 71 of the tab 7 has a sinusoidal configuration and includes a depression 74, which is the first part of the nose portion 71 to press against the end panel 31, when the tail portion 75 of the tab 7 is lifted. The depression 74 is arranged to press adjacent to the vent score 33, rupturing it to create a vent opening 34.

As already mentioned, a problem with pressurised food cans is that upon first opening of the vent score 33, the pressurised head space gases are released very rapidly and may entrain particles of product therein. If a conventional venting system is used (as described above), these entrained particles may be fired towards the user ("spurting"). Hence, it is an aim of the present invention to shield a user from contact with any product ejected from the vent opening 34.

As shown in FIG. 6, upon opening a can end according to the first embodiment of the invention, the sinusoidal shape of the nose portion of the tab not only initiates severing of the vent score 33, but also creates a natural shield 76, to prevent entrained particles of product from being fired towards a user of the can. A disadvantage of this embodiment is that the shield 76 formed by the nose portion 71 of the tab 7 can only accommodate small amounts of product ejected from the container upon venting. Where the product is particularly viscous, large quantities of product may be entrained within the gases vented from the headspace, which cannot be adequately accommodated by this first embodiment.

The inventors have found that a greater quantity of "spurting" can be accommodated if the vent opening 34 is provided distant from the side wall of the body 2 of the can i.e. towards the centre of the end panel 31. A vent in this position minimises the amount of product entrained within the headspace gasses. At the point where the product contacts the side wall of the can body, the product surface is attracted by the side wall and a meniscus forms. Thus, adjacent to the side wall the product surface is closer to the end panel 31 and a vent opening in this position has a greater likelihood of venting headspace gasses in which a large amount of product is entrained.

Figure 9:
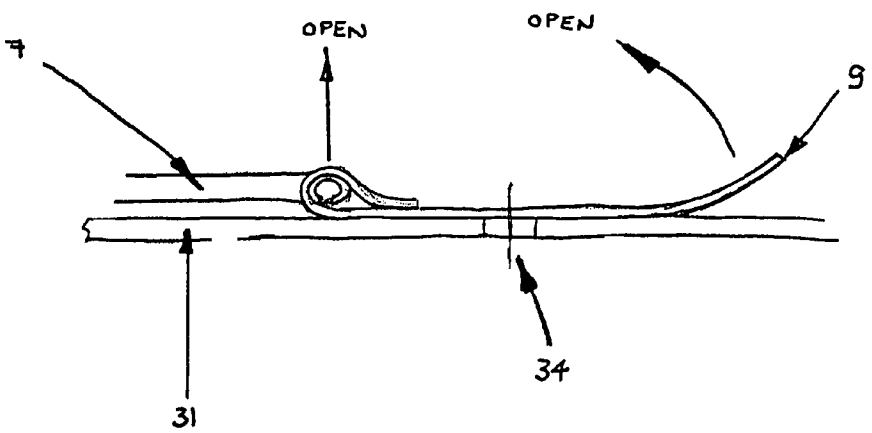
FIG. 9 shows a side section view of the same end as shown in FIG. 8, prior to opening.
Figure 8:
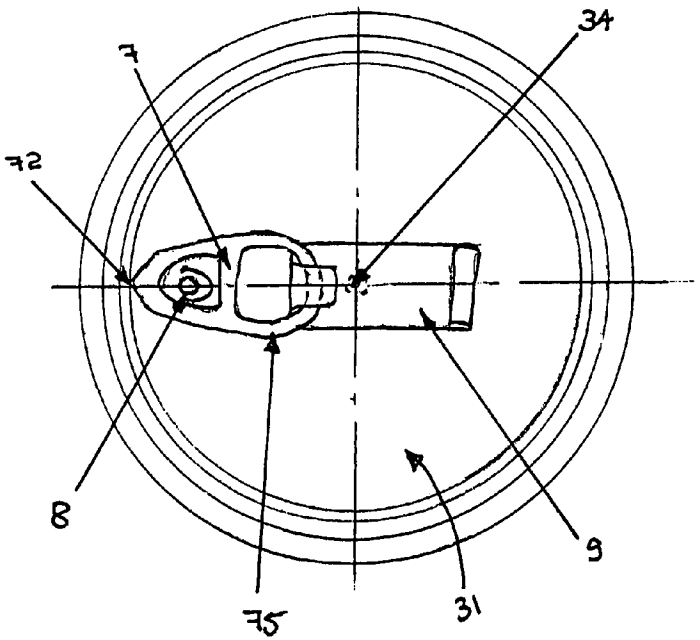
FIG. 8 shows a plan view of an alternative embodiment of the can end according to the invention prior to opening, with the vent aperture provided distant from the aperture score and sealed by a tape.

A simple arrangement of an embodiment having a vent opening positioned in the centre of the can 1 is shown in FIGS. 8 and 9. An easy open end according to this embodiment comprises an end panel 31 and a tab 7 affixed thereto by a rivet 8 as previously described. A vent opening 34 is provided in the centre of the end panel 31 (as shown in FIG. 8). A tape 9, at least adhesive in the vicinity of the vent opening 34 and at one end is affixed to the end panel 31, covering the vent opening 34 and looped around the tail portion of the tab 75. The tape may be removed by pulling its free end upwards (as shown in FIG. 9), but this limits its shield effect when the pressurised headspace gases are released. Preferably therefore, the tape 9 is removed from the vent opening 34, by lifting the tail portion of the tab 75. This means that the tape remains fixed to the end panel 31 on the far side of the vent opening 34 (furthest from the tab 7) and the tape 9 itself shields the vent opening 34 and prevents ejected product from making contact with the user.

A disadvantage of this simple arrangement is that it requires assembly of the tape onto the finished end and tab and this is not cost effective for a mass-produced item. However, this idea inspired the last two embodiments of the invention, in which the vent score is overlain by the tail portion 75 of the tab 7 and is therefore further from the side wall of the can 1.

Figure 10:
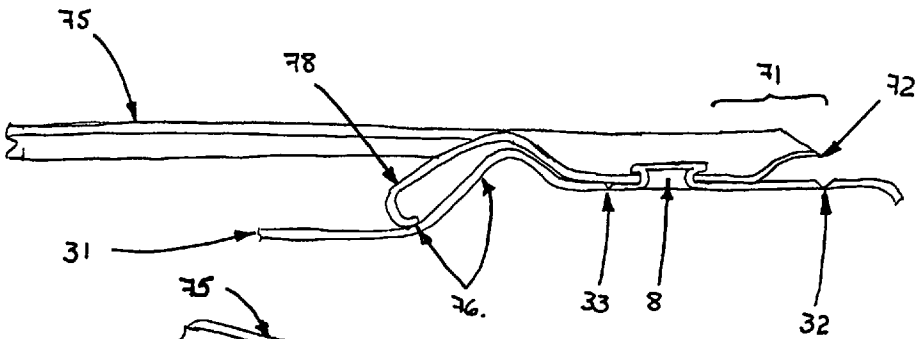
FIG. 10 shows a side section view through a portion of a food can end prior to opening, according to another embodiment of the invention. In this embodiment, the end 3 has a vent score overlain by the tail portion of the tab and a ridge in the plate-like portion of the end, surrounding the vent score to act as a shield.
Figure 11:
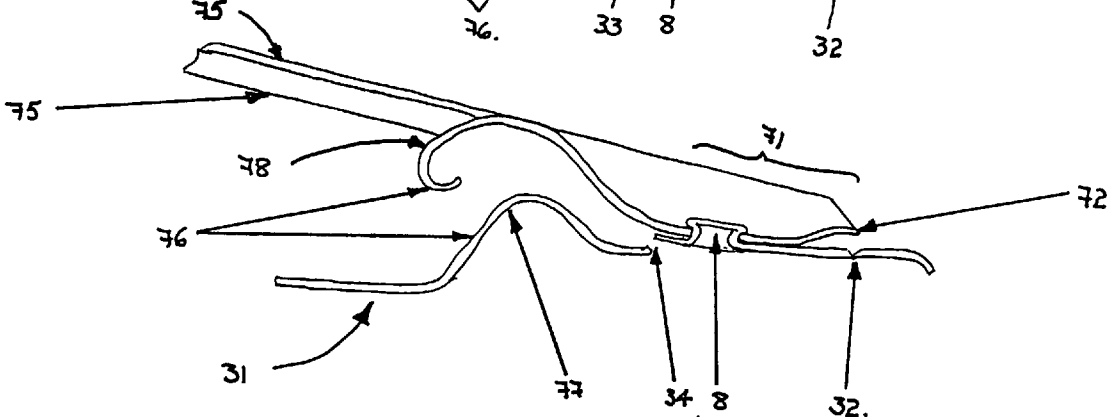
FIG. 11 shows the same side section as shown in FIG. 10 after the tail portion of the tab has been lifted to the extent necessary to open the vent score, but prior to severing of the main aperture score.
Figure 12:
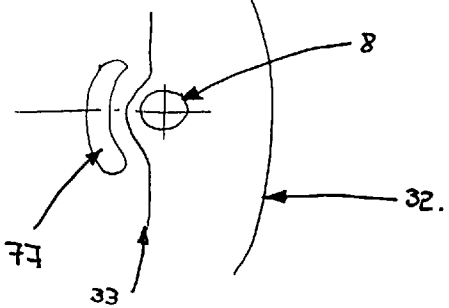
FIG. 12 shows a plan view of a portion of the can end shown in FIGS. 10 and 11 prior to attachment of the tab, showing the layout of the vent score and main aperture score in relation to the position of the rivet.

FIGS. 10 to 12 show a further embodiment of the invention, which incorporates the principles discussed above, but is suitable for mass production. In this embodiment, the vent score 33 is defined in the area overlain by the tail portion 75 of the tab 7 (see FIG. 10). This allows the vent score 33 to be positioned further from the side wall of the can and thereby minimises the "spurting" likely to occur upon first opening of the container.

A user who wants to open the can lifts the tail portion 75 of the tab 7, severing the vent score 33 to create a vent opening 34 (see FIG. 11). The plate-like end panel 31 has a ridge 77 surrounding the vent score 33 and upon first opening, this ridge 77, in conjunction with a catcher element 78 on the tail portion 75 of the tab 7 creates a shield 76, which prevents and product ejected from the vent opening 34 from reaching the user. The orientation of the aperture score 32, vent score 33 and ridge 77 in relation to the rivet 8, can more clearly be understood from FIG. 12. The aperture score 32 is again severed by contact of the nose 72 on or adjacent to the aperture score 32 after the tail portion 75 of the tab 7 has been lifted and the vent score 33 severed to produce a vent opening 34.

Figure 13:
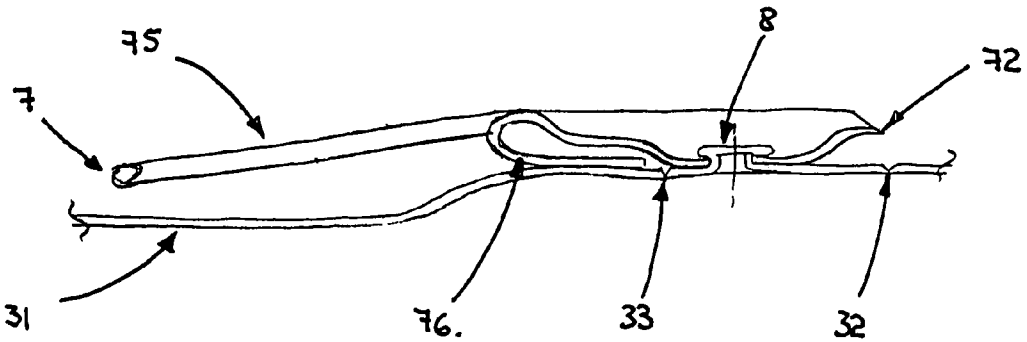
FIG. 13 shows a side section view through a portion of a food can end according to another embodiment of the invention prior to opening, having a vent score and a catching feature defined on the underside of the tail portion of the tab.
Figure 14:
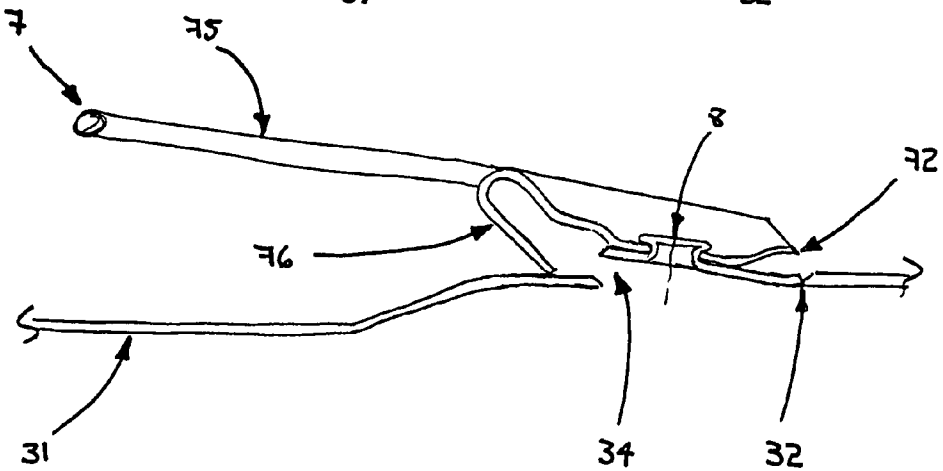
FIG. 14 shows the same side section view as shown in FIG. 13, after tail portion of the tab has been lifted to the extent necessary to open the vent score, but prior to severing of the main aperture score.

A final embodiment of the invention is shown in FIGS. 13 and 14. Again, the vent score 33 is overlain by the tail portion 75 of the tab 7. A guard element on the underside of the tail portion 75 is folded flat against the end panel 31 and held in this folded configuration by the rivet 8. However, the folded guard element is biased towards its upright orientation, orthogonal to the tail portion 75 of the tab 7 (as shown in FIG. 14) and upon lifting of the tail portion, springs into this upright orientation, providing a shield 76 for the vent opening 34.

As will be appreciated, the final two embodiments (shown in FIGS. 10 to 14) are suitable for mass production as the shield 76 is provided by part of the tail portion 75 of the tab 7 and/or features defined on the end plate 31. Further embodiments of the invention will be readily apparent to those skilled in the art, embodying the features described by the claims.

The invention claimed is:

1. An easy open end for a pressurized container comprising an end panel having an aperture score defining the periphery of an aperture panel configured to be removed completely from the end panel, and a tab fixed to the end panel at a connection point, the tab having a nose portion and a tail portion on either side of the connection point, the tail portion having a free end distal the connection point, the tab being arranged with the nose portion on or adjacent to the aperture score to promote rupture thereof when the tail portion is lifted and the tab pivots about the connection point, the end panel also having a vent score constructed and arranged to rupture before rupture of the aperture score thereby releasing the internal pressure from the container before the aperture panel is opened, and the end panel and/or tab defining a shield adapted to prevent the egress of product from the vent opening, wherein the shield comprises a resiliently biased guard element which is activated upon lifting of the tail portion of the tab, and wherein the tab is configured such that only the resiliently biased guard element contacts the end panel at a side of the vent score opposite the connection point.

2. The easy open end as defined in claim 1 wherein the resiliently biased guard element is a folded section of the tail portion of the tab, the folded section being folded flat against the end panel upon connection of the tab to the end panel at the connection point, wherein the folded section is biased toward an orientation orthogonal to the tab.

3. The easy open end as defined in claim 1 wherein the resiliently biased guard element is an upstanding element adjoined to the end panel in an area overlain by the tail portion of the tab and the upstanding element is held flat by the tail portion of the tab upon connection of the tab to the end panel at the connection point.

4. The easy open end as defined in claim 1 wherein the connection point of the tab to the end panel is a rivet.

5. The easy open end as defined in claim 1 wherein the shield further comprises an upstanding ridge on the end panel adjacent to the vent score.

6. The easy open end as defined in claim 1 wherein the resiliently biased guard element is adapted to spring into an upright orientation upon lifting of the tail portion of the tab.

7. An easy open end for a pressurized container comprising:

an end panel having an aperture score defining the periphery of an aperture panel, and a tab fixed to the end panel at a connection point, the tab having a nose portion on a first side of the connection point and a tail portion on a second side of the connection point opposite the first side, the tab being arranged with the nose portion on or adjacent to the aperture score to promote rupture thereof when the tail portion is lifted and the tab pivots about the connection point, the tab and aperture panel being configured to be removed from the container end panel following rupture of the aperture score, the end panel also having a vent score constructed and arranged to rupture upon lifting of the tail portion of the tab, before rupture of the aperture score, thereby releasing internal pressure from the container before the aperture panel is opened, the end panel and/or tab defining a shield adapted to prevent the egress of product from the vent opening, wherein the shield comprises a resiliently biased guard element which is released from a compressed state upon lifting of the tail portion of the tab, wherein the resiliently biased guard element is configured to spring into an upright orientation upon lifting of the tail portion of the tab, and wherein the resiliently biased guard element alone is configured to contact a portion of the end panel adjacent to a side of the vent score opposite the connection point prior to the lifting of the tail portion, and to remain in contact with the end panel during the release of the guard element from a compressed state.

8. The easy open end as defined in claim 7 wherein the resiliently biased guard element is a folded section of the tail portion of the tab, the folded section being folded flat against the end panel and held in this folded configuration against its bias by connection of the tab to the end panel at the connection point, wherein the folded section is biased toward an orientation orthogonal to and away from the tab, and wherein the folded section is configured to unfold away from the tail portion of the tab, upon lifting of the tail portion of the tab.

9. The easy open end as defined in claim 7 wherein the resiliently biased guard element is an upstanding element adjoined to the end panel in an area overlain by the tail portion of the tab and the upstanding element is held flat by the tail portion of the tab upon connection of the tab to the end panel at the connection point.

10. The easy open end as defined in claim 7 wherein the connection point of the tab to the end panel is a rivet.

11. The easy open end as defined in claim 7 wherein the shield further comprises an upstanding ridge on the end panel adjacent to the vent score.

12. The easy open end as defined in claim 7 wherein the resiliently biased guard element is substantially U-shaped and includes:

a first leg portion extending from the connection point toward the tail portion of the tab;

a bow portion extending from an end of the first leg portion distal the connection point and curving back toward the connection point; and a second leg portion extending from an end of the bow portion distal the first leg portion and extending toward the connection point, wherein upon connection of the tab to the end panel at the connection point and prior to lifting of the tail portion of the tab, the second leg portion is spaced apart from the first leg portion, is substantially parallel to the end panel and contacts the end panel along a majority of a length of the second leg portion.

13. The easy open end as defined in claim 12 wherein the first leg portion includes two or more substantially shallow bends disposed between the connection point and the bow section, in a plane substantially perpendicular to the end panel.

* * * * *